US005483815A

United States Patent [19]

West

[11] Patent Number: 5,483,815

[45] Date of Patent: Jan. 16, 1996

[54] PNEUMATIC HOG RING GUN

[76] Inventor: Robert J. West, 752 Hallowell Rd., Pownal, Me. 04069

[21] Appl. No.: 388,396

[22] Filed: Feb. 14, 1995

[51] Int. Cl.[6] ..... B21J 9/18; B21D 7/06; B21F 45/16

[52] U.S. Cl. ..... 72/452; 72/410; 72/453.15; 72/407

[58] Field of Search ..... 72/407, 409, 410, 72/453.16, 453.18, 453.15, 452

[56] References Cited

U.S. PATENT DOCUMENTS 3,015,824 1/1962 Richardson ..... 72/410
3,537,293 11/1970 Gerlach ..... 72/453.16
3,628,230 12/1971 Grise ..... 72/410
3,830,089 8/1974 Boyd et al. ..... 72/407
4,890,474 1/1990 Agostini et al. ..... 72/453.16
5,123,273 6/1992 Kawabata ..... 72/409

*Primary Examiner*—David Jones
*Attorney, Agent, or Firm*—William Nitkin

[57] ABSTRACT

A pneumatic hog ring gun utilizing a pair of pivoting jaws to catch and retain a hog ring for application when a power wedge spreads the rear of the jaws apart, clenching the hog ring, with a lock piston that retains tension on the rear of the jaws before spread by the power wedge to aid in retention of the hog ring. The pneumatic hog ring gun also includes an improved trigger mechanism utilizing air pressure to open and close valves within the hog ring gun.

6 Claims, 3 Drawing Sheets

PNEUMATIC HOG RING GUN

BACKGROUND OF THE INVENTION

1. Field of the Invention

This invention resides in the area of tools for applying hog rings and more particularly relates to a pneumatically operated hog ring gun.

2. Description of the Prior Art

Prior art tools for applying hog rings have generally been relatively complex, heavy, large and noisy, providing for difficult and uncomfortable use. These attributes can lead to fatigue and lower productivity for workers having to use such tools throughout a work day. Prior art tools have also had features to allow the tools to pull and pry pieces, such as fabric and wire, together between a hog ring prior to clinching; to allow ease of loading the hog rings; and to reduce the likelihood of jamming of the hog rings. The structures to add these features have, in general, only increased the complexity, size and weight of prior art tools.

SUMMARY OF THE INVENTION

The pneumatic hog ring gun of this invention has a pistol shape with a balanced center of gravity about its handle that is relatively simple, small, lightweight and quiet, yet incorporates features which provide for pulling workpieces together between the hog ring prior to clinching while at the same time has easy handling, easy reloading, and prevents the jamming of the hog rings.

The principal objects of the present invention can be achieved by providing a pneumatic hog ring gun which includes a piston having a handle and a frame, and a total of five main component pieces detachably connected to the piston frame.

The present invention includes a pair of jaws for clinching hog rings and a lock piston that extends out of the piston and wedges the rear of the jaws apart. The lock piston forces the jaws to hold a hog ring firmly therebetween, yet does not cause the jaws to prematurely clinch the hog ring. The lock piston, therefore, allows the hog ring to be used to pull workpieces together while being held firmly between the jaws.

The present invention also includes a hog ring feed bar for holding and individually dispensing hog rings into position between the jaws. The feed bar is relatively simple and includes a free end for loading the hog rings thereon, making loading quick and easy. The feed bar is also spring connected to the frame. These spring connections allow for some play between the feed bar and frame. The play, in turn, allows an individual hog ring to work its way off the feed bar, between the jaws, without becoming jammed.

Yet another object of the present invention is to provide a pneumatic hog ring gun that is quieter and more comfortable to use. This object is achieved by providing a cover that fits over the handle and most of the piston. The cover, made from thick, rubber-like material similar to that used in wet suits such as Neoprene, muffles the compressed air escaping from the gun, thereby reducing noise. In addition, the cover provides for user comfort by insulating the user's hand against the cold and by cushioning the user's hand from the vibration of the gun.

DESCRIPTION OF THE PREFERRED EMBODIMENT(S)

Figure 1:
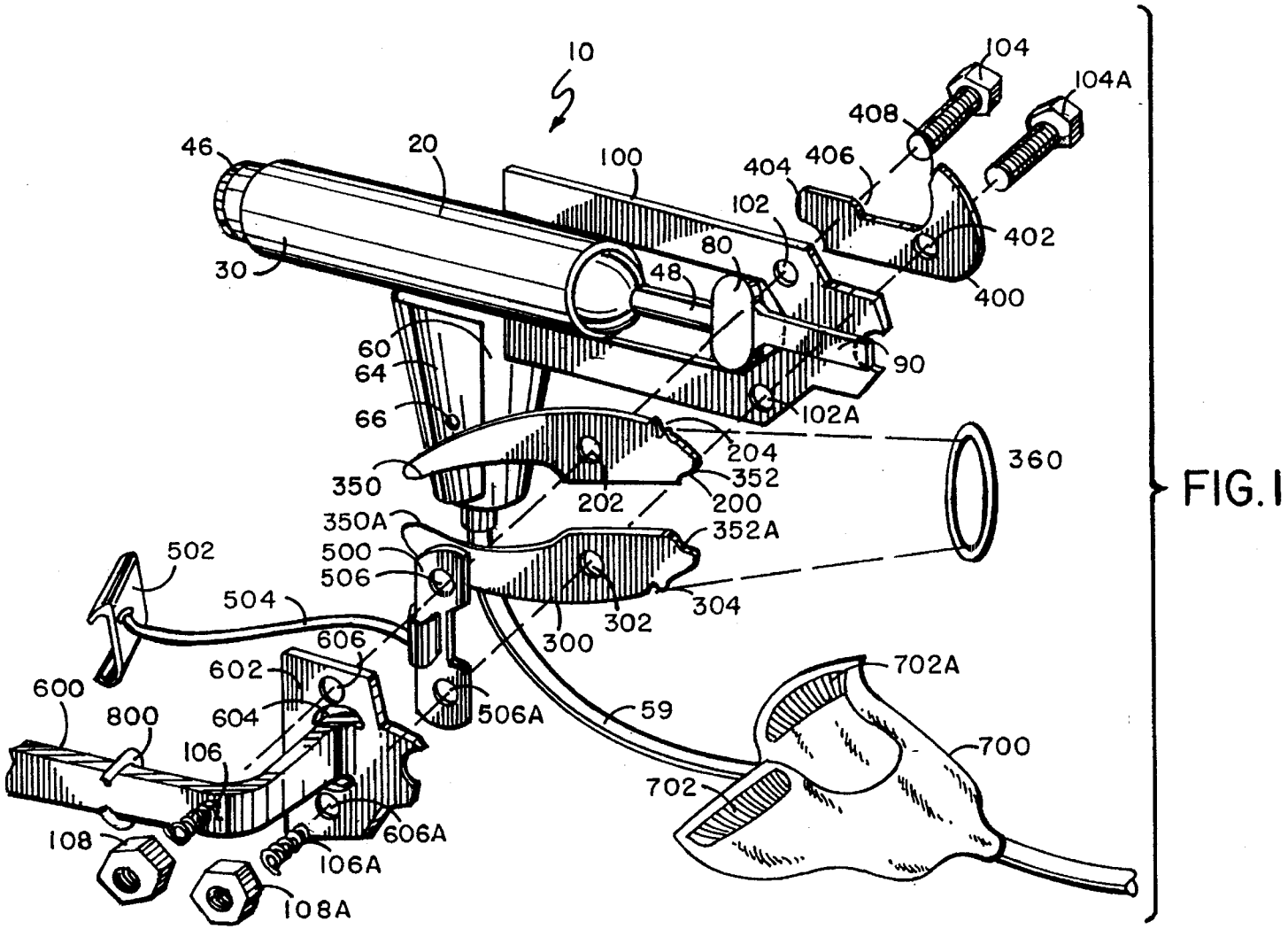
FIG. 1 illustrates an exploded side view of the pneumatic hog ring gun of this invention.

A preferred embodiment of pneumatic hog ring gun 10 is seen in FIG. 1 which includes handle 60, power piston 20, power wedge 80, feed blade 90, frame 100, upper jaw 200, lower jaw 300, lock piston valve actuator lever 400, feed bar 600 and cover 700.

Figure 2:
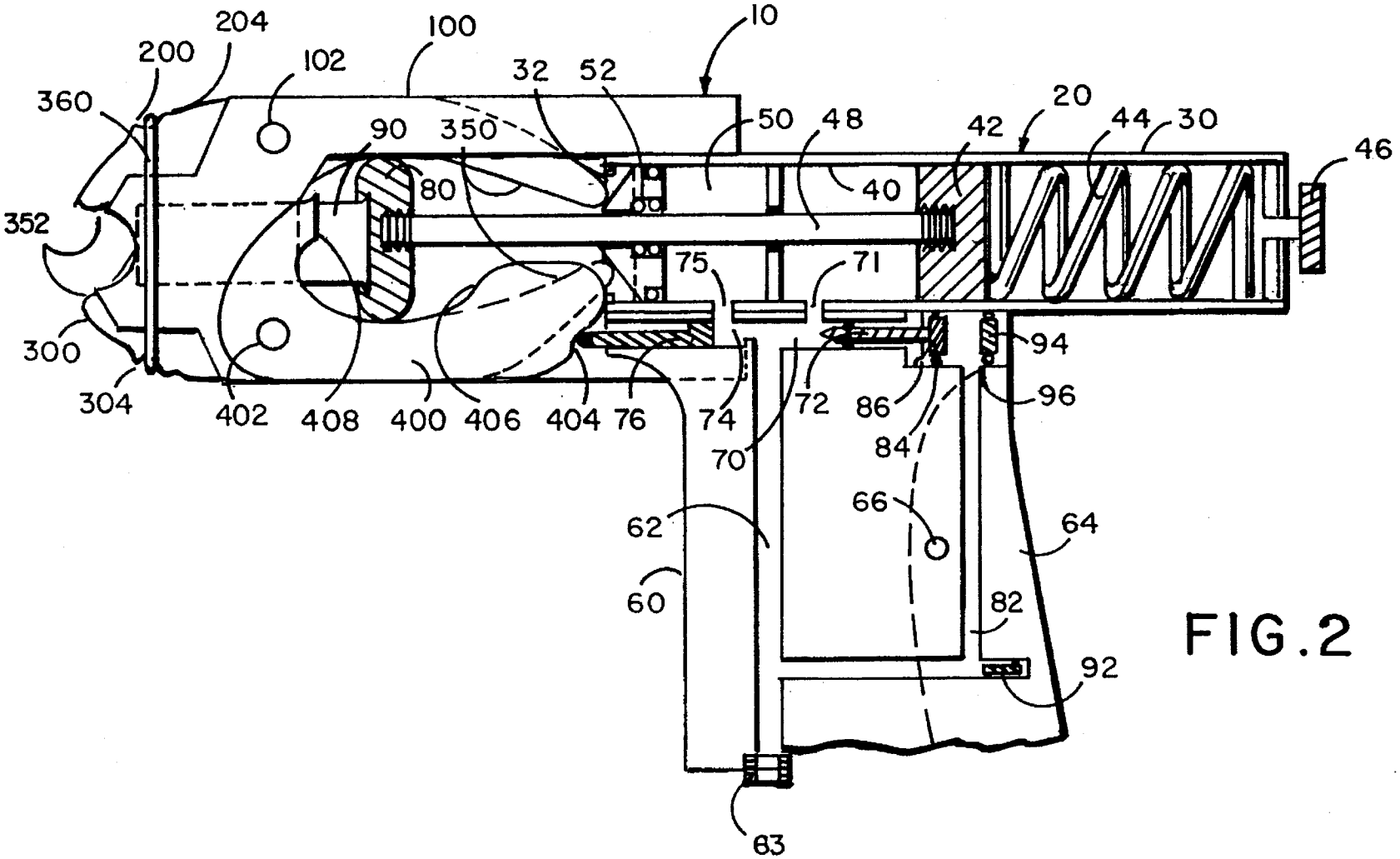
FIG. 2 illustrates a sectional view from the opposite side thereof.

FIG. 2 illustrates a side sectional view of the device from the opposite side from that seen in FIG. 1. Seen in this view is power piston 20 which includes cylinder 30 which is divided into two, air-tight chambers; main piston chamber 40 and lock piston chamber 50. Lock piston chamber 50 contains lock piston 52, while main piston chamber 40 contains main piston 42 and piston spring 44. Piston spring 44 biases main piston 42 towards the front of main piston chamber 40. Adjustment apparatus 46, extending out of the back of power piston 20, can be adjusted to stop the rearward movement of main piston 42 at different positions in main piston chamber 42, thereby adjusting the biasing force applied to main piston 42. It should be noted that although a spring is shown to urge main piston 42 forward, in an alternate embodiment air pressure can be used to accomplish the same result. The first end of shaft 48 is attached to the front of main piston 42, and the shaft extends out of main piston chamber 40, through lock piston chamber 50 and through the aperture in lock piston 52, and out cylinder opening 32.

Also seen in FIG. 2 is handle 60 which contains main air line 62 with hose attachment 63. Main air line 62 divides into main piston chamber air passage 70 and lock piston chamber air passage 74. Passage 74 is bisected by main piston valve 72, and lock piston chamber air passage 74 is bisected by lock piston valve 76. When main piston valve 72 is in the open position, as shown, compressed air can enter main piston chamber 40 through first inlet 71. Likewise, when lock piston valve 76 is in the open position, as shown, compressed air can enter lock piston chamber 50 through second inlet 75. Trigger 64 is pivotally connected at trigger pivot 66 to handle 60 and controls the position of main piston valve 72, as explained below.

Further seen in FIG. 2 is power wedge 80 which is connected to the second end of shaft 48 and feed blade 90 is connected to the other side of power wedge 80. Frame 100 has an opening that surrounds power wedge 80. In addition, frame 100 is connected by welding slightly off-center to the longitudinal axis of power piston 20 to allow feed blade 90 to slide across the front face of frame 100. Lock piston valve actuator lever 400 is pivotally connected to the back face of frame 100 by lower bolt **104*a* which passes through lever bolt hole 402 and frame bolt hole 102*a*. Upper and lower jaws 200 and 300 are pivotally connected to the front face frame 100, with bolts 104 and 104*a* passing through frame bolt holes 102 and 102*a* and respective jaw bolt holes 202 and 302. Jaw elastic band 360 slips over upper and lower jaws 200 and 300 and is retained in jaw elastic band seats being grooves 204 and 304. Jaw elastic band 360 which can be an O-ring adds a compression force to upper and lower jaws 200 and 300 and prevents clinching surfaces 352 and 352*a*** from separating too far during operation of the device.

Referring back to FIG. 1, it will be seen that slide connector plate 500 is attached over upper and lower jaws 200 and 300, onto bolts 104 and 104*a* through bolt holes 506 and 506*a*. Feed bar connector plate 602 is then attached over slide connector plate 500 by bolts 104 and 104*a* passing, respectively, through bolt holes 606 and 606*a*. In operation of the device a plurality of hog rings are slid onto feed bar 600. For purposes of illustration, a single hog ring 800 is shown slid onto the free end of feed bar 600, and then slide 502 is slid over the free end of feed bar 600. Slide tension band 504 connecting slide 502 to slide connector plate 500 pulls slide 502 which, in turn, pushes hog ring 800 toward feed bar connector plate 602. Hog ring-shaped aperture 604 in feed bar connector plate 602 allows hog ring 800 to slide off feed bar 600, through aperture 604 in feed bar connector plate 602, to rest against the front face of frame 100. Bolt springs 106 and 106*a* are positioned, respectively, between nuts 108 and 108*a* and the feed bar connector plate 602 to allow some flexibility and play between connector plate 602 and the front face of frame 100, thereby reducing the likelihood of the hog rings becoming jammed.

Figure 3:
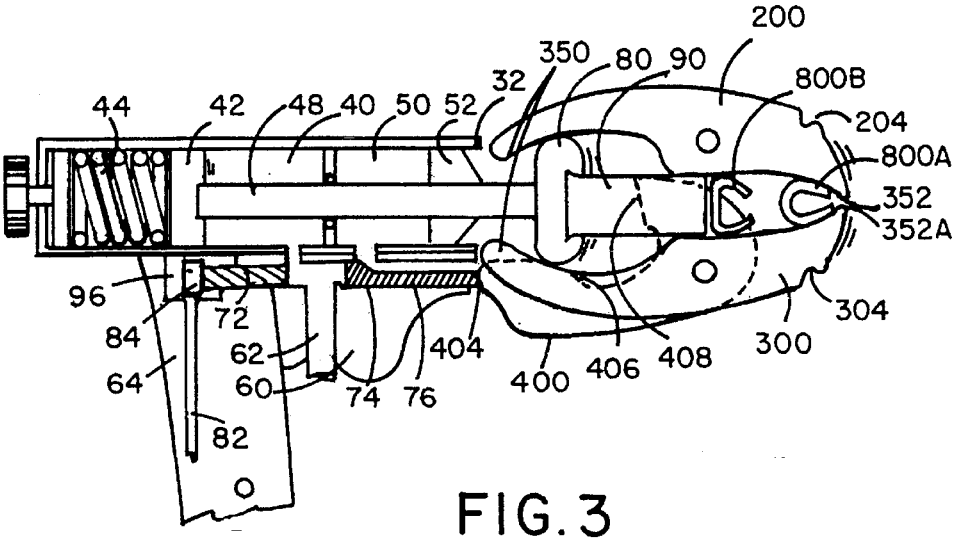
FIG. 3 illustrates a sectional view of the pneumatic hog ring gun clinching a hog ring.
Figure 4:
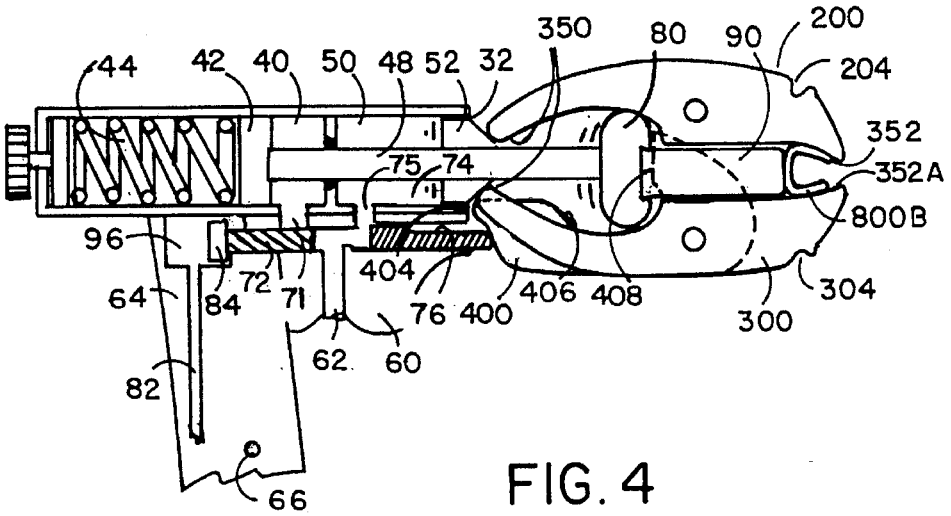
FIG. 4 illustrates a sectional view of the pneumatic hog ring gun holding a hog ring prior to clinching.

FIGS. 3 and 4 show the clinching operation of a hog ring performed by hog ring gun 10. For clarity neither Figure includes jaw elastic band 360, frame 100 or feed bar 600. FIG. 3 shows hog ring 800*a* behind it being crimped and hog ring 800*b* ready to be moved forward by feed slide 90. FIG. 4 shows hog ring 800*b* in position between clinching surfaces 352 and 352*a* of upper and lower jaws 200 and 300, ready to be crimped.

Referring back to FIG. 2, when the lower portion of trigger 64 is manually squeezed toward handle 60, trigger 64 pivots about centrally located trigger pivot 66 and causes the opening of main piston valve 72 as described below. It should be noted that traditional front-located triggers can also be used with the device of this invention. Squeezing trigger 64 on the bottom portion thereof closes trigger valve 92 in air line 82 which extends off main air line 62 within handle 60. The small primary trigger valve 92, when pressure is released on the bottom portion of trigger 64, allows the passage of compressed air through valve air line 82 into trigger cylinder 96. Within trigger cylinder 96 is a non-moving seal piston 94 and a movable trigger piston 84 attached to main piston valve 72. The air pressure forces trigger piston 84 forward which moves main piston valve 72 forward to block the air pressure entrance, being first inlet 71, between main piston chamber air passage 70 and main piston chamber 40. The lack of air pressure within main piston chamber 40 allows piston spring 44 to force main piston 42 forward. When trigger 64 is squeezed at its bottom portion, pivoting on trigger pivot 66, trigger valve 92 is pushed closed by the bottom portion of trigger 64 pushing thereon which closure prevents air from passing through valve air line 82. Air pressure in main air line 62 then forces main piston valve 72 rearward, opening main piston chamber air passage 70 to allow air pressure to enter main piston chamber 40 through first inlet 71, driving main piston 42 rearward, compressing piston spring 44. Main piston 42, in turn, pulls shaft 48, power wedge 80 and feed blade 90 rearward toward lock piston 52. It has been found that trigger piston 84 should be of a larger diameter than the diameter of main piston valve 72 by about a 3:1 ratio. When not activated, trigger 64 is held with its bottom portion at a rearward position by the air pressure in valve air line 82 moving trigger valve 92 rearward which movement keeps valve air line 82 open and main piston valve 72 closed by piston 84. If trigger 64 is pushed on its upper portion, the gun will not activate to clinch a hog ring. Only when the palm of the user's hand depresses the bottom portion of trigger 64 will trigger 64 pivot at trigger pivot 66, closing trigger valve 92 allowing the gun to then activate and clinch a hog ring when main piston valve 72 is forced rearwards by the air pressure through first inlet 71 from main air supply line 62 into main piston chamber air passage 70 pushing back main piston valve 72. When trigger 64 is squeezed on its bottom portion and trigger valve 92 is closed, main piston valve 72 is moved rearward by air pressure in main air passage 62, closing exhaust passage 86. When trigger 64 is released, air pushed trigger valve 92 rearward which, in turn, pushes the bottom portion of the trigger rearward and allows the air pressure to close main piston valve 72. Exhaust 86 allows air to exhaust therethrough from the space in front of trigger piston 84 and in front of main piston 42 as trigger piston 84 moves forward. The exhaust is accomplished by a clearance around the stem of main piston valve 72.

As seen in FIG. 3, about the same time that upper and lower jaws 200 and 300 are released by rearward movement of lock piston 52, power wedge 80 continues to be pulled towards lock piston 52 and contacts curved surfaces 350 and 350*a* of upper and lower jaws 200 and 300. As power wedge 80 continues to move along curved surfaces 350 and 350*a*, the adjacent rear ends of upper and lower jaws 200 and 300 are forced further apart by power wedge 80; and clinching surfaces 352 and 352*a* of upper and lower jaws 200 and 300 are forced together as upper and lower jaws 200 and 300 pivot about bolt holes 202 and 302 seen in FIG. 1. Clinching surfaces 352 and 352*a*, when forced together, clinch hog ring 800*a* held therebetween. While power wedge 80 moves backwards, it takes attached feed blade 90 with it. As feed blade 90 moves backwards, it uncovers hog ring aperture 604, seen in FIG. 1 but not shown in this view, in feed bar connector plate 602, allowing a hog ring to slide off feed bar 600 and rest in front of feed blade 90 against frame 100.

As seen in FIG. 2, upon release of trigger 64, air pressure in valve air line 82 will push trigger valve 92 rearward which will force trigger 64 to pivot about trigger pivot 66; and air pressure in valve air line 82 forces trigger piston 84 forward, thereby moving main piston valve 72 forward to close main piston chamber air passage 70. Closed main piston valve 72 will prevent compressed air from entering the main piston chamber 40 through blocked first inlet 71. Piston spring 44 will then force main piston 42 forward and cause main piston chamber 40 to exhaust through exhaust port 86; and main piston 42 will, in turn, force shaft 48, power wedge 80 and feed blade 90 forward. As seen in FIG. 4, as feed blade 90 moves forward, it pushes hog ring 800*b* between clinching surfaces 352 and 352*a*, forcing clinching surfaces 352 and 352*a* apart. At the same time, power wedge 80, moving forward, contacts power wedge pressure surface 408 on actuating lever 400, forcing actuating lever 400 to pivot about its bolt hole 402, moving lock piston pressure surface 404 off lock piston valve 76. Lock piston valve 76 is then forced open by the compressed air pressure, allowing the compressed air into lock piston chamber 50 through second inlet 75, forcing lock piston 52 forward, into a positive lock with the rear of upper and lower jaws 200 and 300, as described above.

Referring back to FIG. 1, cover 700, if moved upwards on air line pipe 59, fits over handle 60 and most of power piston 20 and is secured by fastening means 702 and 702*a* which can be zippers, Velcro strips or equivalent. Cover 700 which can be made from material similar to that used in wet suits such as Neoprene, provides for user comfort by insulating the user's hand against the cold and by cushioning the hand against the vibration of gun 10. In addition, cover 700 muffles the sound of compressed air escaping from gun 10, thereby reducing noise as well as protecting gun 10 from dirt and other contaminants.

As power wedge 80 moves toward lock piston 52 as seen in FIGS. 2 and 3, it contacts curved surface 406 of lock piston valve actuator lever 400, forcing actuator lever 400 to pivot about bolt hole 402. As actuator lever 400 pivots, valve pressure surface 404 forces lock piston valve 76 to close, preventing compressed air from entering lock piston chamber 50 and allowing compressed air inside chamber 50 to bleed out around lock piston valve 76. Normally lock piston valve 76 is open, allowing compressed air to enter lock piston chamber 50 and force lock piston 52 forward to extend somewhat out of cylinder opening 32. As lock piston 52 moves forward, it contacts the ends of upper and lower jaws 200 and 300, forcing the ends apart and moving clinching surfaces 352 and **352*a* toward one another. Lock piston 52, therefore, creates a positive lock, causing upper and lower jaws 200 and 300 to securely hold hog ring 800*b* in position between clinching surfaces 352 and 352*a* prior to actually being crimped when the trigger is activated. This positive holding action allows the user to hook the opening of the hog ring onto wire or other workpiece material and pull the pieces together before crimping the hog ring. When lock piston valve 76 is closed, lock piston 52 is not forced forward by the air pressure, and upper and lower jaws 200 and 300** are released.

When using a hog ring gun, it is often desirable to be able to push hard on the tool handle to pull wire strands or netting together at the point where the hog ring is to be applied. It is also desirable to have a gun which requires a light force to activate the gun to clinch the hog ring. By positioning trigger pivot 66 near the middle of handle 60 and by using a small trigger valve 92, only a small amount of pressure at the bottom portion of the trigger and a short trigger movement are needed to activate the hog ring gun of this invention. By applying palm pressure to the top portion of the trigger above trigger pivot 66, as much pressure as is needed can be applied to bring the workpieces to be joined into position within the open hog ring without triggering the gun. When the user is ready to trigger the gun, a small squeeze or tilt of the trigger at its bottom portion will cause the gun to activate to clinch the hog ring. The design of the present tool handle and trigger mechanism is intended to reduce the detrimental effects encountered by operators of prior art hog ring tools that are generally held in the front of the handle by three fingers with one trigger finger. With the new design of the handle and trigger mechanism of this invention, the tool can be held and gripped with all the fingers of the hand and can be triggered by squeezing all the fingers of the hand or by pushing the tool against the workpiece with one's whole arm and depressing the bottom portion of the trigger by only minor palm movement when it is desired to activate the tool. This feature reduces the harmful effects of operating a tool requiring one-finger trigger activation.

Although the present invention has been described with reference to particular embodiments, it will be apparent to those skilled in the art that variations and modifications can be substituted therefor without departing from the principles and spirit of the invention.

I claim:

1. A pneumatic hog ring gun operating on compressed air from a compressed air source having a main air line having a second end, said hog ring gun having a front end and a rear end, said hog ring gun for the individual application of a plurality of hog rings, comprising:

a cylinder having a front, a rear, and an opening defined in the front of said cylinder;

a power piston positioned in said rear of said cylinder, said power piston having a main piston chamber defined therein having a front and a rear, said main piston chamber having a first end at said rear of said chamber, a second end at said front of said chamber and a first air inlet aperture defined therein toward said second end;

means to urge said power piston toward said second end of said piston chamber;

means to direct said compressed air from said second end of said main air line through said first air inlet aperture into said main piston chamber, said main piston, thereby being forced rearwards towards said first end;

a shaft having a first end, a second end and a longitudinal axis, said first end attached to said second end of said main piston so that said shaft moves, respectively, backward or forward with said backward or forward movement of said main piston, said second end of said shaft extending out of said second end of said main piston chamber and out said front portion of said power piston;

a power wedge having a height, a front end, a rear end, a top surface, and a bottom surface, said rear end of said power wedge attached to said second end of said shaft so that said power wedge moves, respectively, backwards or forwards with backward and forward movement of said shaft;

a frame attached to said front portion of said power piston, said frame having a front face and a back face, and having an upper and lower pivot members defined thereon;

an upper jaw having a front, a rear and a center, a first end disposed at said rear of said upper jaw, a second end disposed at said front of said upper jaw, said upper jaw having a pivot member attachment defined therein near said center of said upper jaw, said upper jaw having an inwardly curved surface running from said first end to near said upper jaw bolt hole, said curved surface facing downward, said upper jaw having a clinching surface at said second end, said clinching surface facing downward;

a lower jaw having a front, a rear, and a center, a first end disposed at said rear of said lower jaw, a second end disposed at said front of said lower jaw, said lower jaw having a pivot member attachment defined therein near said center of said lower jaw, said lower jaw having an inwardly curved surface running from said first end to near said lower jaw bolt hole, said curved surface facing upward corresponding to said curved surface on said upper jaw, said curved surfaces of said upper and lower jaws being spaced apart at their second ends a distance greater than the height of said power wedge and spaced apart at their first ends a distance less than the height of said power wedge, said lower jaw having a clinching surface at said second end, said clinching surface facing upward corresponding to said clinching surface on said upper jaw;

said upper and lower jaws disposed in line with said longitudinal axis of said shaft, said upper and lower jaw curved surfaces disposed, respectively, above and below said power wedge with the distance between said first ends of said upper and lower jaws being less than the height of said power wedge whereby as said power wedge moves backward, said top and bottom surfaces of said power wedge contact said corresponding curved surfaces of said upper and lower jaws, spreading said curved surfaces apart and pivoting said jaws about their respective jaw bolt holes, thereby forcing said clinching surfaces of said second ends together to clinch a hog ring contained therebetween;

a lock piston chamber defined within said front of said cylinder between said main piston chamber and said cylinder front opening, said lock piston chamber communicating with said cylinder front opening;

a lock piston having a center, said lock piston contained within said lock piston chamber, said lock piston having an aperture defined in its center, said shaft passing through said lock piston chamber and through said aperture in said lock piston, said lock piston when in a full forward position extending out of said front opening of said cylinder and contacting said first ends of said upper and lower jaws and wedging said first ends apart, causing said upper and lower jaws to pivot about said pivot members and bring said clinching surfaces toward one another, said clinching surfaces thereby holding a hog ring securely therebetween, whereby said securely held hog ring may be used to pull workpieces together before actually being clinched; and means to selectively move said lock piston to said full forward position.

2. The pneumatic hog ring gun of claim 1 further including:

a handle;

a second air inlet defined in said lock piston chamber;

a lock piston valve positioned within said handle;

a lock piston air passage defined within said handle, said lock piston air passage having a first end and a second end, said first end communicating with said second end of said main air line, said lock piston air passage communicating through said second air inlet with said lock piston chamber behind said lock piston, said lock piston air passage bisected by said lock piston valve, said lock piston valve extending out of said handle when in its open position, whereby when in said open position said lock piston valve allows compressed air into said lock piston chamber, biasing said lock piston to its full forward position, said lock piston valve when in said closed position preventing compressed air from entering said lock piston chamber and relieving forward biasing pressure on said lock piston; and a lock piston valve actuating lever having a front, a rear, a first end disposed at said rear of said lever, a second end disposed at said front of said lever, and a pivot attachment defined in said lever, said first end having a lock piston valve pressure surface, said second end curving upward higher than said pivot attachment and having a power wedge pressure surface, said lever further including a portion running from said first end to near said pivot attachment forming an inwardly curved surface, said curved surface facing upward, said lever secured to said back face of said frame by said pivot members, said second end of said lever disposed in front of said front of said power wedge, said first end of said lever disposed above said extending end of said lock piston valve, said curved surface of said lever disposed below said power wedge, said first end of said lever positioned above said bottom of said power wedge, whereby as said power wedge moves rearward, said bottom surface of said power wedge contacts said curved surface of said lever, pushing down said curved surface and pivoting said lever about said pivot members, and as said lever pivots, said valve pressure surface contacts said lock piston valve, pushing said lock piston valve rearward thereby closing said lock piston valve, and when said power wedge returns to its forward position, it contacts said power wedge pressure surface of said lever, pivoting said lever back to its original position moving said valve pressure surface off said lock piston valve, allowing said lock piston valve to be opened by pressure of compressed air in said lock piston air passage thereby allowing said compressed air through said second air inlet into said lock piston chamber.

3. A pneumatic hog ring gun operating on compressed air from a compressed air source, said hog ring gun having a front end and a rear end, said hog ring gun for the individual application of a plurality of hog rings, comprising:

a cylinder having a front, a rear, and an opening defined in the front of said cylinder;

a power piston positioned in said rear of said cylinder, said power piston having a main piston chamber defined therein having a front and a rear, said main piston chamber having a first end at said rear of said chamber, a second end at said front of said chamber and a first air inlet aperture defined therein toward said second end;

a piston spring positioned in said main piston chamber toward said first end;

a main piston having a first end and a second end, said main piston in a first mode disposed between said piston spring and said first air inlet aperture, said piston spring biasing said main piston toward said first air inlet aperture, whereby in its second mode when compressed air is forced through said first air inlet aperture into said main piston chamber, said main piston is forced rearwards towards said first end, compressing said spring;

a shaft having a first end, a second end and a longitudinal axis, said first end attached to said second end of said main piston so that said shaft moves, respectively, backward or forward with said backward or forward movement of said main piston, said second end of said shaft extending out of said second end of said main piston chamber and out said front portion of said power piston;

a power wedge having a height, a front end, a rear end, a top surface, and a bottom surface, said rear end of said power wedge attached to said second end of said shaft so that said power wedge moves, respectively, backwards or forwards with backward and forward movement of said shaft;

a frame attached to said front portion of said power piston, said frame having a front face and a back face, and having an upper and lower bolt hole defined therein, said upper and lower bolt holes traversing said front and back faces, said upper bolt hole located above said lower bolt hole, said holes being equidistant from said power piston;

an upper jaw having a front, a rear and a center, a first end disposed at said rear of said upper jaw, a second end disposed at said front of said upper jaw, said upper jaw having a bolt hole defined therein near said center of said upper jaw, said upper jaw having an inwardly curved surface running from said first end to near said upper jaw bolt hole, said curved surface facing downward said upper jaw having a clinching surface at said second end, said clinching surface facing downward;

a lower jaw having a front, a rear, and a center, a first end disposed at said rear of said lower jaw, a second end disposed at said front of said lower jaw, said lower jaw having a bolt hole defined therein near said center of said lower jaw, said lower jaw having an inwardly curved surface running from said first end to near said lower jaw bolt hole, said curved surface facing upward corresponding to said curved surface on said upper jaw, said curved surfaces of said upper and lower jaws being spaced apart at their second ends a distance greater than the height of said power wedge and spaced apart at their first ends a distance less than the height of said power wedge, said lower jaw having a clinching surface at said second end, said clinching surface facing upward corresponding to said clinching surface on said upper jaw;

an upper and lower bolt extending, respectively, through said upper jaw bolt hole and said lower jaw bolt hole to secure said upper and lower jaws to said front face of said frame with said upper and lower bolts inserted, respectively, through said upper and lower frame bolt holes and said corresponding upper and lower jaw bolt holes, said upper and lower jaws disposed in line with said longitudinal axis of said shaft, said upper and lower jaw curved surfaces disposed, respectively, above and below said power wedge with the distance between said first ends of said upper and lower jaws being less than the height of said power wedge whereby as said power wedge moves backward, said top and bottom surfaces of said power wedge contact said corresponding curved surfaces of said upper and lower jaws, spreading said curved surfaces apart and pivoting said jaws about their respective jaw bolt holes, thereby forcing said clinching surfaces of said second ends together to clinch a hog ring contained therebetween;

a handle attached to said power piston, said handle having a main air line having a first end and a second end;

means for connecting said first end of said main air line to said compressed air source;

a main piston valve having a body and an end;

a trigger piston disposed on said end of said main piston valve;

a main piston chamber air passage defined in said handle, said main piston chamber air passage having a first end and a second end, said first end of said main piston chamber air passage attached to said second of said main air line, said second end of said main piston chamber air passage communicating through said first air inlet aperture with said main piston chamber, said main piston chamber air passage bisected by said main piston valve, said main piston valve in a first position blocking said main piston chamber air passage and in a second position allowing air pressure from said main air line through said main piston chamber air passage, through said first air inlet aperture and into said piston chamber;

a trigger pivotally attached to said handle, said trigger to activate movement of said main piston valve from said first position where said main piston valve is closed to said second position by manually squeezing said trigger to open said main piston valve, allowing said main piston chamber air passage to communicate with said main piston chamber;

a feed blade having a first end and a second end disposed toward said front of said hog ring gun, said first end attached to said front end of said power wedge opposite said second end of said shaft so that said feed blade moves backwards and forwards, respectively, with said backward and forward movement of said power wedge, said second end of said feed blade extending between said upper and lower jaws behind said clinching surfaces of said upper and lower jaws, said second end disposed in front of said front face of said frame;

a hog ring feed bar having a first end and a second end, said plurality of hog rings being mounted thereon at said first end;

a feed bar connector plate attached to said second end of said hog ring feed bar, said feed bar connector plate having an upper bolt hole and a lower bolt hole defined therein corresponding, respectively, to said upper and lower bolt holes of said frame, said feed bar connector plate having a hog ring aperture defined therein between said upper and lower bolt holes and around said second end of said hog ring feed bar, said hog ring feed bar connector plate attached to said frame, over said upper jaw, by said upper and lower bolts so that said hog ring aperture is positioned over said feed blade;

a slide tension band having a first end and a second end;

a slide member connected to said first end of said slide tension band;

a slide connector plate connected to said second end of said slide tension band, said slide connector plate having an upper bolt hole and a lower bolt hole defined therein corresponding, respectively, to said upper and lower bolt holes of said frame, said slide connector plate attached by said upper and lower bolts to said frame between said upper and lower jaws and said feed bar connector plate, said slide connector plate shaped so as not to block said hog ring aperture of said feed bar connector plate, said first end of said hog ring feed bar being loaded with said plurality of hog rings thereon, followed by said slide member, said tension band pulling said slide member toward said feed bar connector plate so that said slide member pushes said hog rings toward said hog ring aperture whereby, as said feed blade is moved rearward, unblocking said hog ring aperture, an individual hog ring is forced through said hog ring aperture, against said frame, and between said upper and lower jaws; and as said feed blade is moved forward, back into its original position, said feed blade pushes said individual hog ring forward until it rests between said clinching surfaces of said upper and lower jaws:

an upper nut and a lower nut;

an upper bolt spring and a lower bolt spring positioned, respectively, on said corresponding upper and lower bolts, between said feed bar connector plate and corresponding upper and lower nuts threaded onto the ends of said upper and lower bolts whereby said upper bolt spring and said lower bolt spring cooperate, respectively, with said upper and lower bolts and said upper and lower nuts to securely, yet flexibly, connect said feed bar connector plate, said slide connector plate and said upper and lower jaws to said frame, thereby reducing the likelihood of a hog ring becoming jammed between said upper and lower jaws;

a lock piston chamber defined within said front of said cylinder between said main piston chamber and said cylinder front opening, said lock piston chamber communicating with said cylinder front opening;

a lock piston having a center, said lock piston contained within said lock piston chamber, said lock piston having an aperture defined in its center, said shaft passing through said lock piston chamber and through said aperture in said lock piston, said lock piston when in a full forward position extending out of said front opening of said cylinder and contacting said first ends of said upper and lower jaws and wedging said first ends apart, causing said upper and lower jaws to pivot about said bolt holes and bring said clinching surfaces toward one another, said clinching surfaces thereby holding a hog ring securely therebetween, whereby said securely held hog ring may be used to pull workpieces together before actually being clinched;

a second air inlet defined in said lock piston chamber;

a lock piston valve positioned within said handle;

a lock piston air passage defined within said handle, said lock piston air passage having a first end and a second end, said first end communicating with said second end of said main air line adjacent to said main piston chamber air passage, said second end of said lock piston air passage communicating through said second air inlet with said lock piston chamber behind said lock piston, said lock piston air passage bisected by said lock piston valve, said lock piston valve extending out of said handle when in its open position, whereby when in said open position said lock piston valve allows compressed air into said lock piston chamber, biasing said lock piston to its full forward position, said lock piston valve when in said closed position preventing compressed air from entering said lock piston chamber and relieving forward biasing pressure on said lock piston; and a lock piston valve actuating lever having a front, a rear, a first end disposed at said rear of said lever, a second end disposed at said front of said lever, and a bolt hole defined in said lever, said first end having a lock piston valve pressure surface, said second end curving upward higher than said bolt hole and having a power wedge pressure surface, said lever further including a portion running from said first end to near said bolt hole forming an inwardly curved surface, said curved surface facing upward, said lever secured to said back face of said frame by said lower bolt inserted through said lock piston valve actuating lever bolt hole and said lower bolt hole of said frame, said second end of said lever disposed in front of said front of said power wedge, said first end of said lever disposed above said extending end of said lock piston valve, said curved surface of said lever disposed below said power wedge, said first end of said lever positioned above said bottom of said power wedge, whereby as said power wedge moves rearward, said bottom surface contacts said curved surface of said lever, pushing down said curved surface and pivoting said lever about said bolt hole, and as said lever pivots, said valve pressure surface contacts said lock piston valve, pushing said lock piston valve rearward thereby closing said lock piston valve, and when said power wedge returns to its forward position, it contacts said power wedge pressure surface of said lever, pivoting said lever back to its original position moving said valve pressure surface off said lock piston valve, allowing said lock piston valve to be opened by pressure of compressed air in said lock piston air passage thereby allowing said compressed air through said second air inlet into said lock piston chamber.

4. The pneumatic hog ring gun of claim 3 further including:

a first jaw elastic seat defined within said upper jaw above said upper jaw clinching surface, said jaw elastic seat defining an upper groove;

a second jaw elastic seat defined within said lower jaw below said lower jaw clinching surface, said jaw elastic seat defining a lower groove; and a jaw elastic band stretched around said second ends of said upper and lower jaws, said jaw elastic band retained in said first and second jaw elastic seats whereby said jaw elastic band pressures said clinching surfaces together, limiting the distance between said clinching surfaces during operating of said pneumatic hog ring gun.

5. The pneumatic hog ring gun of claim 4 further including:

adjustment means to stop the movement of said piston backward in said cylinder at various locations, thereby changing the extent of rearward movement of said power piston so that output force of said power piston is adjusted.

6. The pneumatic hog ring gun of claim 5 further including:

a cover; and means to attach said cover to said handle and most of said power piston.

* * * * *